United States Patent [19]

McCord, Jr.

[11] Patent Number: 4,925,385

[45] Date of Patent: May 15, 1990

[54] FUEL IGNITER

[76] Inventor: Harry C. McCord, Jr., 6306 N. 500 W., Marion, Ind. 46952

[21] Appl. No.: 387,955

[22] Filed: Jul. 31, 1989

[51] Int. Cl.[5] ..... F23Q 7/06

[52] U.S. Cl. ..... 431/2; 431/263; 123/260; 60/39.827

[58] Field of Search ..... 431/2, 263, 264, 266, 431/258; 123/260; 60/39.827

[56] References Cited

U.S. PATENT DOCUMENTS

| | | | |
|---|---|---|---|
| 2,090,039 | 8/1937 | Goddard | 431/263 |
| 4,014,777 | 3/1977 | Brown . | |
| 4,023,545 | 5/1977 | Mosher et al. . | |
| 4,276,131 | 6/1981 | Feuerman . | |
| 4,450,060 | 5/1984 | Gonzalez . | |
| 4,519,341 | 5/1985 | McGarr . | |
| 4,721,081 | 1/1988 | Krauja et al. . | |
| 4,747,925 | 5/1988 | Hasebe et al. . | |

*Primary Examiner*—Randall L. Green

*Attorney, Agent, or Firm*—Woodard, Emhardt, Naughton, Moriarty & McNett

[57] ABSTRACT

An apparatus for the continuous ignition of fuel, including substantially aqueous fuel, has a housing with a closed end, an open end and a continuous side wall with a spark generator at the closed end. The open end is covered by a cap which defines an exhaust port. A spark passing from the spark generator to the cap ignites the fuel. A method for continuously igniting the fuel involves passing the fuel through an electric arc created between a spark generator and a cathodic surface.

20 Claims, 2 Drawing Sheets

FUEL IGNITER

BACKGROUND OF THE INVENTION

1. Field of the Invention

This invention relates generally to electro-chemical fuel ignition systems, and particularly to an apparatus for the generation of gases from a fuel and the continuous ignition thereof.

2. Background of the Invention

It has been realized for sometime that reliance on petroleum products as a fuel source must be curtailed. One reason for this is that petroleum resources are available in only a finite supply and no method is presently known for replenishing these natural resources. The same is true for natural gas. At the present rates of consumption, the depletion of petroleum resources is foreseeable.

Another reason supporting the curtailment of petroleum fuels relates to environmental concerns. Recently, much attention has been focused on the by-products of petroleum burning. These by-products are certainly a major source of urban pollution, and may even contribute to such contemporary problems as acid rain.

Accordingly, there is a need for an alternate fuel source which is vast and/or replenishable. Preferably, such a fuel source is also free of the dangerous pollutants that petroleum fuels emit as they are burned. Water or substantially water containing fuels address both of these requirements. A drawback in exploiting water as a fuel relates to methods for converting present petroleum product and natural gas users into water users.

It is known to use hydrogen and oxygen derived from the electrolytic dissociation of water as a fuel source or as a fuel efficiency enhancer. For example, U.S. Pat. No. 4,014,777 to Brown relates to welding, brazing or the like utilizing a mixture of hydrogen and oxygen generated in substantially stoichiometric proportions in an electrolytic cell by electrolytic dissociation of water. The mixture so generated is passed to a burner where the gases are ignited. Brown also relates to atomic welding in which the above-mentioned mixture of hydrogen and oxygen is passed through an arc causing dissociation of the water into atomic hydrogen and oxygen which on recombination generate an intensely hot flame.

U.S. Pat. No. 4,023,545 to Mosher et al discloses a gas generating system for use with internal combustion engines, which provides hydrogen gas and oxygen gas to be intermixed with the petroleum-based fuel for the engine. The system of Mosher comprises an electrolysis unit which is energized by the existing electrical system normally associated with an internal combustion engine. The unit utilizes distilled water and sodium hydroxide as the electrolyte. The system further includes means for conducting ambient air into the electrolysis unit for agitating or mixing the electrolyte and removing the gases that accumulate on the anode and cathode. The unit comprises a stainless steel tank as well as stainless steel anode and cathode members.

U.S. Pat. No. 4,276,131 to Feuerman describes an automobile engine fueled with a mixture of air and a vapor derived by passing electric current through an electrolytically conductive emulsion of gasoline and water. Specific compositions of the conductive emulsions are disclosed, as are specific designs for vaporizers for the fuel. Gaseous hydrogen and oxygen are present in the vapor.

U.S. Pat. No. 4,450,060 to Gonzalez discloses a reciprocating motor having an electrolytic cell for generating a combustible mixture of hydrogen and oxygen gases, the cell being connected to the input/output port of the piston cylinder assembly, and means for igniting the combustible mixture in the cylinder as well as a particular configuration of the motor and its parts. The recycling of hydrogen and oxygen gases to the electrolytic cell through the input/output port is taught.

It is also known that certain alcohol-water mixtures are acceptable secondary fuels in combination with petroleum based fuels. In this regard, U.S. Pat. No. 4,519,341 to McGarr teaches an alcohol-water injection system which first electrically heats an alcohol-water mixture to a superheated gaseous state, then utilizes the vacuum conditions in a carburetor to control the flow of the gaseous alcohol-water mixture into the intake manifold of the engine where it mixed with gasoline and air from the carburetor to power the engine.

Further, certain alcohols are known to be useful as alternate fuels. U.S. Pat. No. 4,721,081 to Krauja discloses a fuel combustion system, utilizing a glow plug and designed to completely ignite and burn relatively lower-cetane-number alternative fuels such as one hundred percent methanol or ethanol. The Krauja system is designed to overcome the problem that conventional direct-injection internal combustion engines having a fuel injector with multiple fuel spray orifices do not completely ignite and burn such fuels.

The previously known oxygen and hydrogen burning systems required the use of two stages. The first stage generates the gases from an electrolytic cell or tank. For example, U.S. Pat. No. 4,747,925 to Hasebe et al describes an electrolytic tank for generating oxygen and hydrogen and facilitating the separation of the generated gas bubbles from the electrolyte solution. The second stage is the burning of the gases generated in the first stage. Previous two-stage systems generally required complex structures and occupy considerable space. The design is taught to be useful in welding, cutting, heating, and lighting, etc., applications.

SUMMARY OF THE INVENTION

The present invention includes a single stage apparatus for continuous ignition of a fuel including a housing having a closed end, an open end and a continuous side wall with a spark generator disposed at the closed end for generating a spark within the housing. An intake port supplies fuel into the housing. A cap covering the open end defines an exhaust port therethrough and includes a cathodic surface, so that the spark passes from spark generator to the cathodic surface through the fuel to ignite the fuel. The ignited fuel is discharged from the housing through the exhaust port.

Another aspect of the present invention is a system for continuous ignition of a substantially aqueous fuel having a tank containing the substantially aqueous fuel and a fuel line supplying the fuel to a housing. An intake port supplies fuel into the housing. The housing has a closed end, an open end and a continuous side wall with a spark generator disposed at the closed end for generating a spark within the housing. A cap covering the open end defines an exhaust port therethrough and includes a cathodic surface, so that the spark passes from spark generator to the cathodic surface through the fuel to ignite the fuel. The ignited fuel is discharged from the housing through the exhaust port.

A further aspect of the present invention involves a method for continuously igniting fuel by supplying the fuel to a housing having an open end covered by a cap defining an exhaust port. The supplied fuel is then ignited by subjecting it to an electric arc created by applying a voltage from a spark generator to a cathodic surface and exhausted through the exhaust port.

It is an object of the present invention to provide an apparatus for the continuous ignition of fuels having relatively few of the pollutant by-products associated with the burning of traditional petroleum-based fuels. It is another object of the present invention to provide a compact fuel ignition apparatus.

A further object of the present invention is to provide an apparatus for continuously igniting hydrogen gas and oxygen gas which does not require a separate electrolytic cell to generate the gases. It is still a further object of the present invention to provide a fuel ignition system capable of being used in a wide variety of applications by simply scaling up or down the component parts, depending on the intended use.

Other objects and advantages of the invention may be discerned by persons of ordinary skill in the art after reviewing the following written description and accompanying figures.

DESCRIPTION OF THE PREFERRED EMBODIMENT

Figure 2:
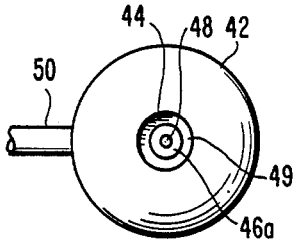
FIG. 2 is a top plan view of the fuel igniter of FIG. 1.
Figure 4:
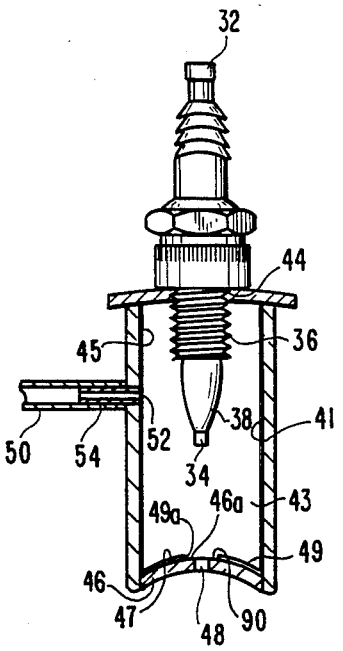
FIG. 4 is a partial cross-sectional view of the fuel igniter of FIG. 1.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
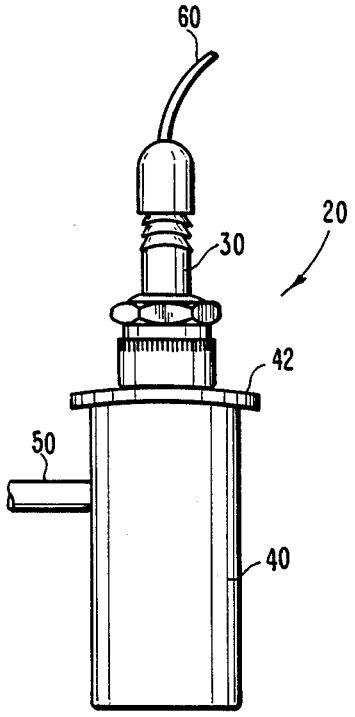
FIG. 1 is a front elevational view of a fuel igniter according to one embodiment of the present invention.

A first embodiment of the present invention is illustrated in FIGS. 1 through 4. FIG. 1 shows a front elevational view of a fuel igniter 20 made according to the present invention and scaled for use in a furnace for home heating. A housing 40 is equipped with a lid 42 which has been adapted to receive a spark plug 30. A fourteen millimeter hole 44 is shown in cap 42 (FIG. 4), threaded to accommodate the threaded surface 36 on a standard automotive spark plug 30. On the opposite end of the housing is inserted a concave cap 46 exhaust port 48 formed therethrough. In the preferred embodiment, the port 48 has a diameter of approximately one-eighth inch.

Intake port 52 is present in the continuous side wall 41 of the cylinder 40 in a position laterally near the anodic spark generating end 34 of spark plug 30. Tube 54 is placed in port 52 as a fitting to receive a fuel line 50. Fuel line 50 is preferably made of insulated hose so that electrical power applied to the spark plug 30 does not pass up the fuel line 50. Being electrically connecting to ground, concave cap 46 is cathodic. In one specific embodiment, the cap 46 and wall 41 are conductive and the wall is grounded, thereby grounding the cap.

The internal surface of side wall 41 of cylinder 40 has a coating or layer 45 with a non-conducting or electrically insulating material that can withstand the high temperatures and electric charges present in the chamber 43 when the fuel igniter is in operation. Porcelain materials and certain glasses are suitable for this purpose. Also, the internal surface 47 of concave cap 46 preferably includes a coating 49 of similar material except in the area near exhaust port 48. Additionally, standard spark plugs are provided with porcelain coatings 38 adjacent to the sparking end 34. The coating 45 prevents arcing from the spark generating end 34 to the side wall 41, while the coating 49 is provided to focus the spark toward the exhaust port 48.

In one specific embodiment, the entire interior concave surface 47 of the cap 46 is coated with the non-conductive material so that only the bar metal of the exhaust port 48 is an exposed cathodic surface. In another specific embodiment, the coating 49 terminates at a perimeter **49*a* about the port 48 so that an annulus 46*a*** of bare metal around the exhaust port is exposed cathodic surface.

It will be understood that the dimensions given herein should not be considered to limit the application of the present invention. The dimensions may easily be scaled to facilitate installation of the present fuel igniter into a variety of other devices including rockets, internal combustion engines and the like. Also, it is not essential that an automatic spark plug be used as a spark generator. Other components which may be used to generate a spark will be readily apparent to those skilled in the art.

In operation, the fuel igniter of the present invention is connected to a power source through standard spark plug connector 60. Fuel enters chamber 43 through intake port 52. Because of the location of intake port 52 laterally adjacent spark generating end 34 the vaporized fuel must pass through the high voltage arc created between the spark generating end 34 and the exhaust port 48 in the concave cap 46. For this purpose, exhaust port 48 is preferably located on the apex of concavity 90 of cap 46. Most preferably, the distance from the spark generating end 34 to the exhaust port 48 will be shorter than the distance from the spark generating end 34 to any other point on the housing 40. It will also be recognized that concave cap 46 may be made vertically slidably adjustable relative to the spark generating end 34 so that the distance between exhaust port 48 and spark generating end 34 can be optimized for complete and continuous ignition of the fuel. If the position of concave cap 46 is adjustable, the igniter 20 may be installed in a system and then the position of concave cap 46 adjusted either toward or away from spark generating end 34 to achieve the desired ignition characteristics. As a result of exposure to the high voltage arc between the spark generating end 43 and the exhaust port 48, the fuel in chamber 43 is ignited, producing a flame exhausted through exhaust port 48.

Fuel which may be ignited in the device of the present invention includes pure water or water-alcohol mixtures including, but not limited to, a mixture of water and a composition similar to common windshield washer fluid commercially available from several well known sources. One fluid is Ready Mixed Windshield Washer manufactured by Clifton Chemical Co. of Chebanse, Illinois 60922. One advantage of the water/windshield washer fluid mixture is that methanol present in the washer fluid inhibits freezing of the fuel and also possesses rust inhibiting properties. Further, while water alone will ignite in a device according to the present invention, the flame is enhanced by the addition of another component like methanol. Additionally, hydrochloric acid and cadmium sulfide may be mixed with trace amounts of magnesium and titanium in the fuel composition to enhance the output.

Figure 5:
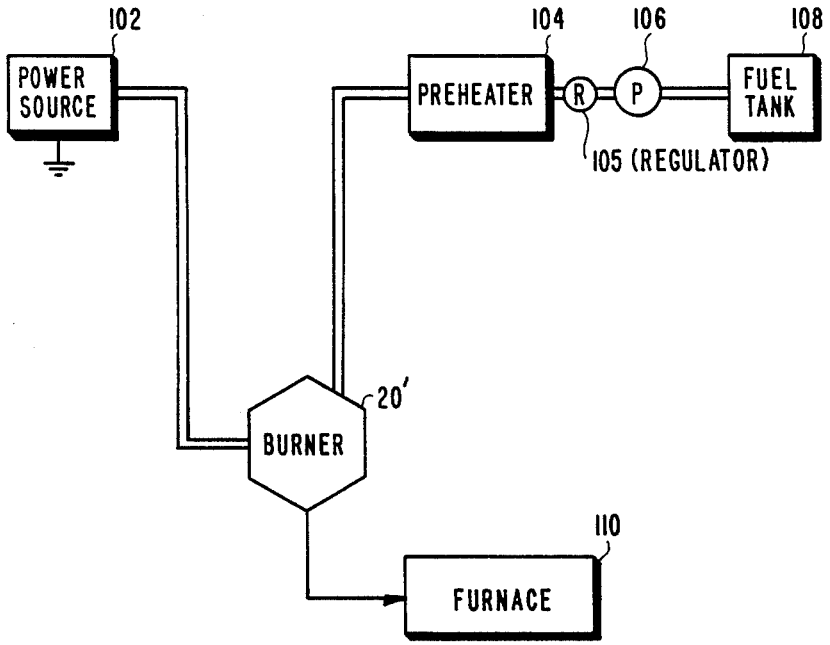
FIG. 5 is a schematic showing the fuel igniter of the present invention incorporated in a furnace system.

For the purposes of illustration, FIG. 5 shows a schematic of the present invention in one embodiment as installed in a home heating system which includes a furnace 110. A 10,000 volt, 0.023 amp power source 102 is connected to fuel igniter 20' to provide electrical power to the spark generator. It is understood that the voltage and amperage can vary according to the size of the igniter and the application.

Fuel may be supplied from a fuel tank 108. The fuel supplied to a preheater 104 is regulated by pump 106 or by regulator 105. The preheater 104 is preferably activated only during initial start-up. A 900 watt preheater is ample for the purposes of preheating the fuel. The fuel tank 108 is preferably pressurized. For this purpose, a conventional gas supply cylinder may be used. Even when fuel tank 108 is pressurized, the flow of fuel from the tank to the preheater should be regulated and for this purpose regulator 105 may be used and pump 106 omitted. Preferably, sixty psi of pressure is maintained in fuel tank 108 and seven to fifteen psi of pressure is maintained from the preheater 104 to the fuel igniter 20. Further, since ignition within the fuel igniter 20' is self-sustaining, the fuel need not be preheated after start-up. In this case, the preheater component 104 may be shut off until initial firing of igniter 20' is again required. Alternatively, a preheater coil may be placed beneath tank 108 to maintain a fuel temperature at or near the vaporization point. Flow regulator 105 is still required between the fuel tank 108 and the igniter 20' but preheater 104 may be eliminated.

The igniter 20' is identical in structure and operation to the igniter previously described. The diameter of exhaust port of the igniter 20' is preferably optimized to maintain a preferred flame size through the exhaust port. A smaller diameter results in a smaller flame but if the diameter is too large no flame is produced. In the specific embodiment, the flame produced from the system is approximately five to six hundred BTU's, more or less. The rate of burning may be controlled by adjusting the pressure from fuel tank 108 or preheater 104 into fuel igniter 20'. The resulting flame in the system of FIG. 5 is directed into a furnace 110 to heat air flowing past the flame. The heated air then passes, for example, through a conventional furnace blower such as that found in presently available forced air heating systems.

Figure 6:
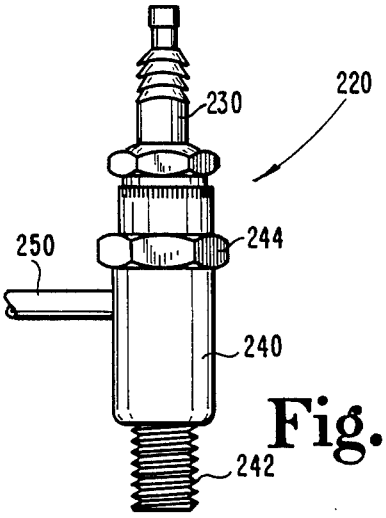
FIG. 6 is a front elevational view of an alternate embodiment of a fuel igniter according to the present invention.
Figure 3:
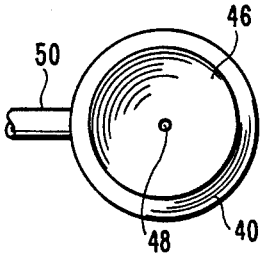
FIG. 3 is a bottom view of the fuel igniter of FIG. 1.
Figure 7:
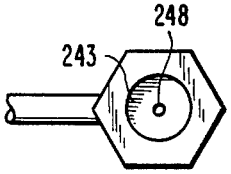
FIG. 7 is a top plan view of the fuel igniter of FIG. 6 shown with the spark plug removed from the housing.

FIGS. 6 and 7 show an alternate embodiment of a fuel igniter 220 made according to the present invention. FIG. 7 is top plan view of the alternate embodiment with the spark plug 230 removed from the housing 240. Housing 240 which defines chamber 243 is formed as an adapter to be received within conventional spark plug receptacles of automotive internal combustion engines. This adaptation is accomplished by forming the bottom of housing 240 as a male adapter 242 threaded on its outer surface to mate with the threaded portion of a conventional spark plug cavity in the engine. In this manner, the fuel igniter 220 may be fitted to an internal combustion engine so that the burned fuel provides a flame exiting exhaust port 248. Fuel igniter 220 is shown provided with a hexhead top 244 for tightening within the spark plug receptacle of an internal combustion engine or for removal of the housing 240. In other respects, the operation of the igniter 240 is much the same as described in connection with furnace igniter models.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for continuous ignition of a substantially aqueous fuel comprising:

a housing having a closed end, an open end and a continuous side wall;

means disposed at said closed end for generating a spark within said housing;

fuel intake means for supplying fuel into said housing; and a cap covering said open end, said cap defining an exhaust port therethrough and including a cathodic surface, whereby the spark passes from said spark generating means to said cathodic surface through the fuel to ignite the fuel such that the ignited fuel is discharged from said housing through said exhaust port.

2. The apparatus of claim 1 wherein said cap is coated with an electrically non-conducting material except at said cathodic surface.

3. The apparatus of claim 2 wherein said exhaust port opens at said cathodic surface.

4. The apparatus of claim 3 wherein said exhaust port includes a bore defining said cathodic surface.

5. The apparatus of claim 2 wherein said non-conducting material is a porcelain.

6. The apparatus of claim 1, wherein said cap is concave, and further wherein the apex of concavity is the point on the cap closest to said spark generating means.

7. The apparatus of claim 6 wherein said exhaust port is centered on the apex of concavity.

8. The apparatus of claim 1 wherein said fuel intake means includes an intake port, said intake port connected to a fuel line, and further includes a fuel preheater interposed in said fuel line between a fuel tank and said housing.

9. The apparatus of claim 1 wherein said side walls are coated with a non-conducting material.

10. The apparatus of claim 1 wherein said cap is slidable within said housing relative to said spark generating means.

11. The apparatus of claim 1 and further comprising means connected to said fuel intake means for vaporizing the fuel.

12. A system for continuously igniting substantially aqueous fuel comprising:

a tank containing substantially aqueous fuel;

a housing having a closed end, an open end and a continuous side wall;

means disposed at said closed end for generating a spark within said housing;

a cap covering said open end, said cap defining an exhaust port therethrough and including a cathodic surface, whereby the spark passes from said spark generating means to said cathodic surface through the fuel to ignite the fuel such that the ignited fuel is discharged from said housing through said exhaust port;

fuel intake means for supplying fuel form said tank into said housing; and means for regulating the supply of fuel from said tank into said housing.

13. The system of claim 12 wherein said fuel intake means includes an intake port, said intake port connected to a fuel line, and further includes a fuel preheater interposed in said fuel line between said tank and said housing.

14. The apparatus of claim 12 wherein said cap is coated with an electrically non-conducting material except at said cathodic surface.

15. The apparatus of claim 12, wherein said cap is concave, and further wherein the apex of concavity is the point on the cap closest to said spark generating means.

16. A method for continuously igniting a fuel comprising the steps of:

supplying fuel to a housing having a cap defining an exhaust port and a cathodic surface;

igniting the supplied fuel by subjecting the fuel to an electric arc created by applying a voltage from a spark generator to the cathodic surface; and exhausting the ignited fuel through the exhaust port.

17. The method of claim 16 and further comprising the step of vaporizing the fuel prior to said subjecting step.

18. The method of claim 16 wherein the step of supplying includes pressurizing the fuel.

19. The method of claim 18 wherein said pressurizing is to about 60 psi.

20. The method of claim 16 wherein the step of supplying includes regulating the flow of fuel into the chamber.

* * * * *